US005121850A

United States Patent [19]

Morel

[11] Patent Number: 5,121,850

[45] Date of Patent: Jun. 16, 1992

[54] VERTICAL MOVEMENT CLOSING DEVICE FOR VARIOUS CONTAINERS

[75] Inventor: Simone Morel, Montmirail, France

[73] Assignee: Societe de Conseils et d'Etudes des Emballages SCEE, Seine et Marne, France

[21] Appl. No.: 561,193

[22] Filed: Aug. 1, 1990

[30] Foreign Application Priority Data

Aug. 2, 1989 [FR] France ..... 89 10414

[51] Int. Cl.[5] ..... B65D 43/26

[52] U.S. Cl. ..... 220/262

[58] Field of Search ..... 220/254, 260, 262, 263, 220/264

[56] References Cited

U.S. PATENT DOCUMENTS 4,099,642 7/1978 Nergarz ..... 290/90.4

4,286,515 9/1981 Baumann et al. ..... 220/262 X

*Primary Examiner*—Stephen Marcus

*Assistant Examiner*—Nova Stucker

*Attorney, Agent, or Firm*—Robert W. Becker & Associates

[57] ABSTRACT

A vertical movement closing device for various containers is provided. The closing device includes a cap that covers at least partially the top of a body on which it is mounted in such a way as to be able to slide. The body is provided with a stirrup that is slidably mounted transversely with respect to its longitudinal axis. Cam forming means are disposed between the stirrup and cap for causing the axial displacement of the cap during the transverse displacement of the stirrup.

8 Claims, 3 Drawing Sheets

VERTICAL MOVEMENT CLOSING DEVICE FOR VARIOUS CONTAINERS

BACKGROUND OF THE INVENTION

The present invention relates to closing devices in plastic material, which are used in many industries for closing, respectively opening various containers with a hollow body, or in which circulate fluids which have to be distributed, either directly or via applicator accessories.

The invention applies more particularly but not exclusively to those closing devices which are displaced in an axial direction of the body supporting them and allowing the distribution of a fluid also in an axial direction of the body.

SUMMARY OF THE INVENTION

According to the invention, the vertical movement closing device for various containers comprises a cap covering at least partially the top of a body on which it is mounted in a slidable manner, this body being provided with a stirrup mounted in such a way as to be slidable transverse with respect to the longitudinal axis of the body, and cam forming means being operatively disposed between the stirrup and the cap to effect an axial displacement of the cap during transverse displacement of the stirrup.

Various other features of the invention will become more apparent from the following detailed description.

Embodiments of the object of the invention are shown by way of non limiting examples in the accompanying drawings.

BEST EMBODIMENTS OF THE INVENTION

Figure 1:
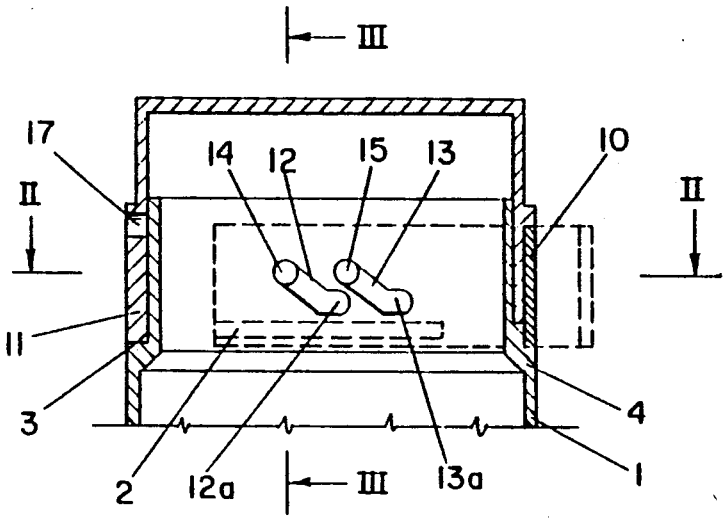
FIG. 1 is a partly schematic elevation and sectional view of the closing device of the invention.

In the drawings, there is shown at 1 the body of an article which has to be provided with a closing device. Body 1 can be for example a container.

Body 1 defines, at least in its upper portion, two plane side portions 1*a*, 1*b* from which are formed longitudinal small bars 2, 3 defining, with shoulders 4, 5 of the body, slots 6, 7 for guiding slides 8, 9 formed in a stirrup 10 shaped so as to extend on either side of the side portions 1*a*, 1*b* of body 1 and for enveloping one of its front sides.

Shoulders 4, 5 of body 1 are also used as a bearing surface for a cap 11 having side and end cut-outs corresponding to stirrup 10.

Cap 11 defines, in its side inner wall, oblique slots 12, 13 ending into rectilinear portions 12*a*, 13*a*.

As shown in the drawing, the stirrup 10 comprises slides 8, 9 and studs 14, 15 engaged inside the oblique slots 12, 13 of cap 11.

If desired, cap 11 can be covered by a removable lid 16.

In the rest position, cap 11 bears on shoulders 3, 4 of body 1, and stirrup 10 is also applied on the free portions of the shoulders 3, 4 so that it is not or only a little apparent. In this rest position, studs 14, 15 are in the higher portion of the oblique slots 12, 13, as shown in FIG. 1.

Figure 2:
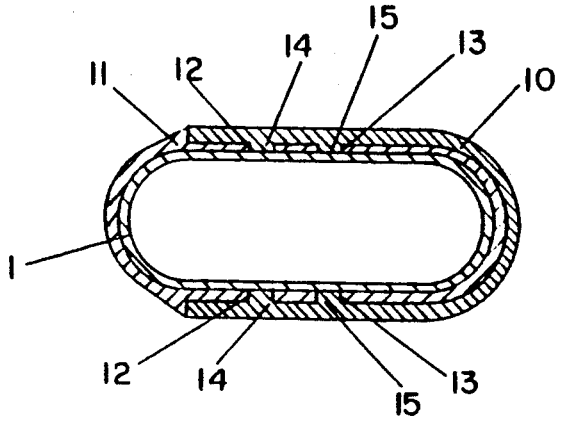
FIG. 2 is a sectional view substantially along line II—II of FIG. 1.
Figure 3:
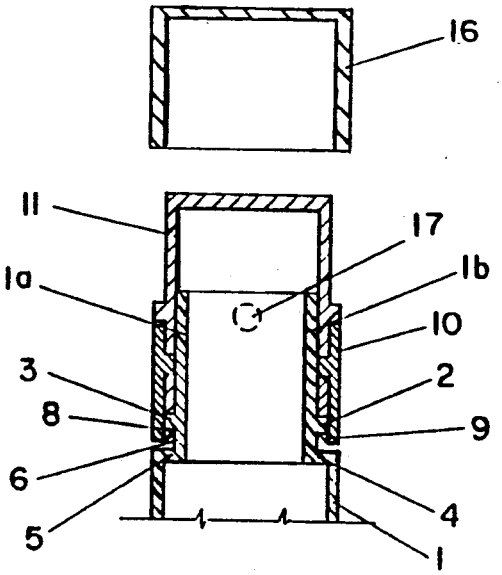
FIG. 3 is a sectional view taken substantially along line III—III of FIG. 1.
Figure 4:
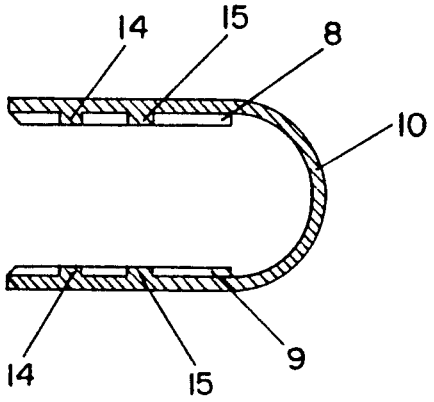
FIG. 4 is a top plan view of a member which is part of the closing device of the preceding figures.

By displacing stirrup 10 in order to bring it in a position in which it is shown in dashed lines in FIGS. 1 and 2, the stirrup 10 is guided in slots 6, 7 in which are engaged the slides 8, 9. Therefore, the stirrup 10 has been displaced in a direction substantially perpendicular to the longitudinal axis of body 1.

The displacement of the stirrup causes a displacement of studs 14, 15 which are moved in slots 12, 13 in the manner of cams, thereby causing the raising of cap 11 which is guided by the wall of body 1.

At the end of the stroke of stirrup 10, studs 14, 15 are in the rectilinear portions 12*a*, 13*a* and, consequently, cap 11 is maintained in a stable position since a pressure possibly exerted on it does not allow bringing it back to the aforementioned rest position, hereabove described, as long as stirrup 10 is not as such brought back to its initial position.

From the foregoing disclosure, it is clear that the device as described can form a vertical movement closing device for closing opening means of body 1 when the latter body 1 is that of a flask or other container.

By way of example and only in order that the embodiment shown in FIGS. 1 to 4 will be operational, a hole 17 at least is formed in cap 11 so as to show that this hole is closed when cap 11 is in the rest position and, on the contrary, is spaced apart from the top of body 1 when the cap is raised.

Figure 5:
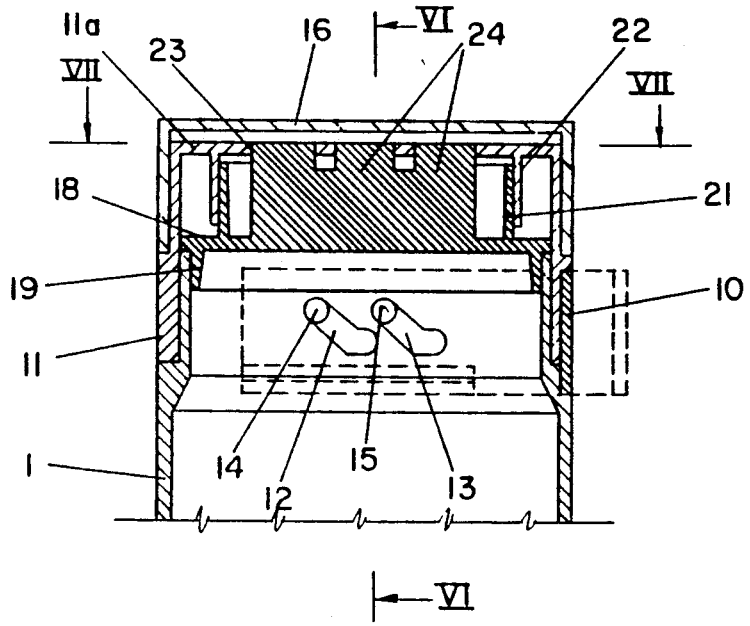
FIG. 5 is a sectional view similar to FIG. 1 illustrating an application of the closing device to a distributing container.
Figure 6:
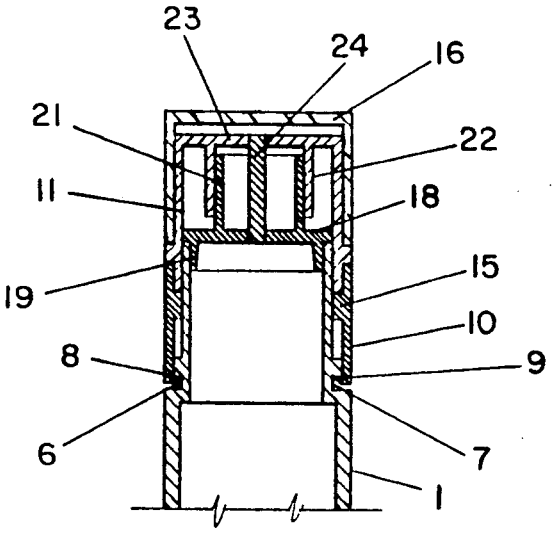
FIG. 6 is a sectional view substantially along line VI—VI of FIG. 5.
Figure 7:
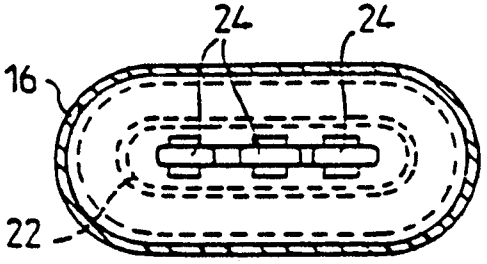
FIG. 7 is a sectional view substantially along line VII—VII of FIG. 5.

FIGS. 5 to 7 illustrate a first advantageous application of the invention according to which a plug 18 is engaged, via a skirt 19 which it includes, in the top of body 1 in order to bear thereon. The plug 18 defines passage holes 20 inside a sealing socket 21 which protrudes above the plug 18 and cooperates with a sealing skirt 22 formed inside cap 11.

In that case, cap 11 has a top 11*a* with holes 23 for closing fingers 24 formed from the top of plug 18 inside the sealing socket 21.

Assuming that body 1 is made of a container, when the stirrup is displaced in order to be brought to the position shown in dashed lines in FIG. 5 and after removal of the removable cover 16, cap 11 is raised in the same manner as described hereabove in relation with FIGS. 1–4, and, consequently, a fluid contained in body 1 can flow through the holes 23 which can be afterwards closed again by bringing stirrup 10 back to its initial position.

Figure 9:
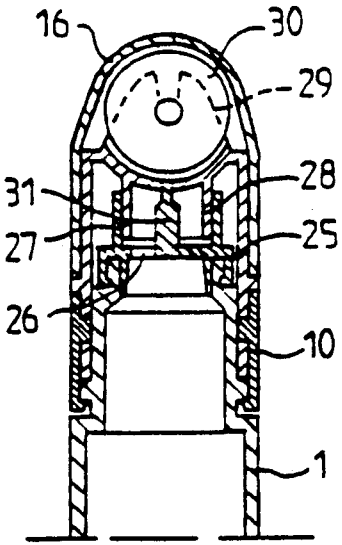
FIG. 9 is a sectional view along IX—IX of FIG. 8.
Figure 8:
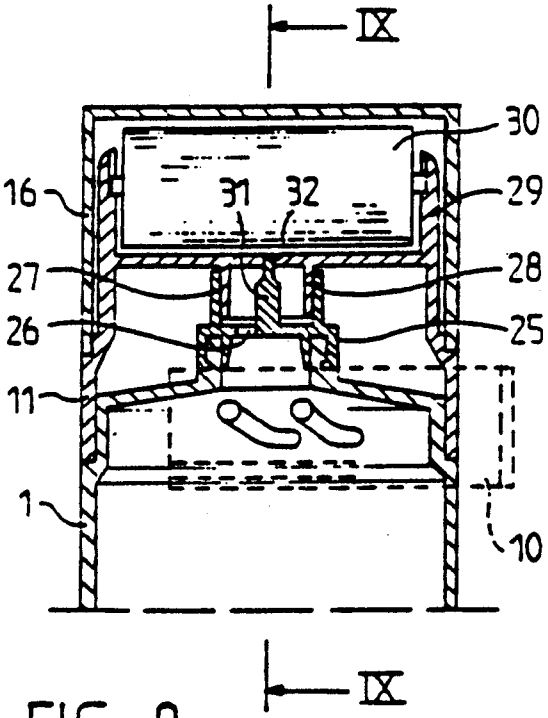
FIG. 8 is a sectional view similar to FIG. 5 illustrating another application of the closing device.

FIGS. 8 and 9 illustrate another embodiment according to which body 1 has a top supporting a plug 25, formed with at least one hole 26, placed inside a sealing socket 27 cooperating with a sealing skirt 28, formed on the top of the cap which is provided with lugs 29 used for supporting an application roller 30.

As in the preceding example of FIGS. 5–7, a closing finger 31 is formed at the top of plug 25 and extends inside a hole 32 in the top of cap 11, when the latter is in the rest position.

After removal of the removable cover 16, an actuation of stirrup 10 causes the raising of cap 11 and, consequently, the opening of hole 32, thereby allowing impregnating the application roller 30 with the product contained in the body 1.

Figure 10:
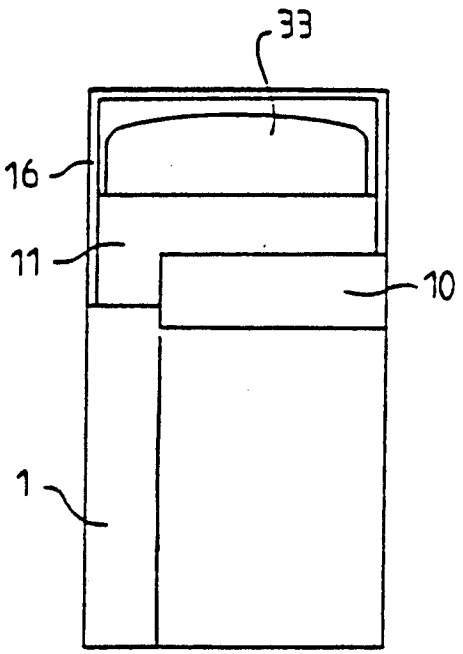
FIG. 10 is a side elevation view illustrating a third application of the closing device.

FIG. 10 shows still another application according to which cap 11 is made for example in a similar manner as that disclosed with reference to FIG. 8 and is provided, instead of roller 30, with a sponge 33 or any other porous product which can thus be impregnated with any product contained in the body 1.

The invention is not limited to the embodiments shown and described in detail since various modifications can be carried out without departing from its scope.

What I claim is:

1. A vertical movement closing device for the bodies of various containers, comprising:

a cap that at least partially covers the top of a body on which it is mounted in a slidable manner;

a stirrup that is mounted on said body in such a way as to be slidable transverse with respect to the longitudinal axis of said body, wherein said body is provided with shoulders, and said cap is provided with a cutout corresponding to said stirrup and along with said stirrup is disposed above said shoulders, wherein said body has lateral sides that are provided with small, outwardly protruding bars that define slots between said shoulders and said small bars, and wherein said stirrup is provided with guiding slides that are disposed in said slots; and cam means operatively disposed between said stirrup and said cap to effect an axial displacement of said cap during transverse displacement of said stirrup.

2. A closing device according to claim 1, in which said cam means includes slot means provided on one of said cap or stirrup, and studs provided on the other of said stirrup or cap, with said studs engaging said slot means.

3. A closing device according to claim 2, in which said slot means are provided in said cap and have rectilinear portions for accommodating said studs, which are disposed on said stirrup, when said stirrup occupies its transversely displaced position, which corresponds to a raised portion of said cap relative to said body.

4. A closing device according to claim 3, in which said cap is provided with distribution means.

5. A closing device according to claim 4, in which said container body has a top that is provided with a plug, the top of which is provided with at least one closing finger for selectively closing and opening said distribution means, which is in the form of at least one hole provided in the top of said cap.

6. A closing device according to claim 5, in which the top of said cap supports an application roller, sponge, or similar porous product, which is in communication with said at least one hole.

7. A closing device according to claim 5, in which the top of said plug is provided with a sealing socket in which is disposed said closing finger; and in which said cap is provided with a sealing skirt that cooperates with said sealing socket.

8. A closing device according to claim 7, in which said cap is provided with a removable lid.

* * * * *